US007916160B2

(12) United States Patent
Hsu et al.

(10) Patent No.: US 7,916,160 B2
(45) Date of Patent: Mar. 29, 2011

(54) IMAGE PROCESSING APPARATUS AND METHOD FOR ADJUSTING GRAY LEVELS OF AN IMAGE SIGNAL INPUTTED TO A FLAT DISPLAY PANEL

(75) Inventors: Yung-Sheng Hsu, Kaohsiung (TW); Yu-Wen Huang, Sanchung (TW); Hsin-Hung Lee, Fongshan (TW)

(73) Assignee: Quanta Computer Inc., Tao Yuan Shien (TW)

( * ) Notice: Subject to any disclaimer, the term of this patent is extended or adjusted under 35 U.S.C. 154(b) by 957 days.

(21) Appl. No.: 11/818,791

(22) Filed: Jun. 14, 2007

(65) Prior Publication Data

US 2008/0012810 A1 Jan. 17, 2008

(30) Foreign Application Priority Data

Jul. 17, 2006 (TW) ..... 95125982 A

(51) Int. Cl.
*G09G 5/10* (2006.01)

(52) U.S. Cl. ..... 345/690

(58) Field of Classification Search ..... None
See application file for complete search history.

(56) References Cited

U.S. PATENT DOCUMENTS

| | | | | |
|---|---|---|---|---|
| 5,115,229 | A * | 5/1992 | Shalit | 345/2.2 |
| 6,559,826 | B1 * | 5/2003 | Mendelson et al. | 345/102 |
| 2003/0016199 | A1 * | 1/2003 | Lee et al. | 345/88 |
| 2004/0155837 | A1 | 8/2004 | Yu et al. | |
| 2005/0030305 | A1 * | 2/2005 | Brown et al. | 345/207 |
| 2005/0190135 | A1 | 9/2005 | Chen et al. | |

FOREIGN PATENT DOCUMENTS

| | | |
|---|---|---|
| CN | 1549233 A | 5/2003 |
| CN | 1641415 A | 1/2004 |
| TW | 1236656 | 1/2004 |

OTHER PUBLICATIONS

Office Action from Chinese Patent Office dated May 8, 2009 in Chinese.

* cited by examiner

*Primary Examiner* — Alexander Eisen
*Assistant Examiner* — Matthew Yeung
(74) *Attorney, Agent, or Firm* — Thomas I Kayden

(57) ABSTRACT

The invention discloses an image processing apparatus for adjusting gray levels of an image signal inputted to a flat display panel (FDP). The image processing apparatus comprises a memory unit and a processing unit. The memory unit stores a panel characteristic LUT. When receiving the image signal, the processing unit will adjust the gray levels of the image signal according to the panel characteristic LUT, so as to output an adjusted image signal complying with the panel characteristic of the FDP.

12 Claims, 7 Drawing Sheets

GainTable

| gray level | 0 | 1 | ... | 33 | ... | 254 | 255 |
|---|---|---|---|---|---|---|---|
| gain of R | R_G_000 | R_G_001 | ... | 0.85 | ... | R_G_254 | R_G_255 |
| gain of G | G_G_000 | G_G_001 | ... | 0.88 | ... | G_G_254 | G_G_255 |
| gain of B | B_G_000 | B_G_001 | ... | 0.72 | ... | B_G_254 | B_G_255 |

FIG. 4

GrayTable

| gray level | 0 | 1 | 2 | 3 | 4 | ... | 252 | 253 | 254 | 255 |
|---|---|---|---|---|---|---|---|---|---|---|
| output value of R | 0 | 1 | 2 | 4 | 4 | ... | 251 | 252 | 254 | 255 |
| output value of G | 0 | 1 | 2 | 3 | 5 | ... | 252 | 253 | 254 | 255 |
| output value of B | 0 | 1 | 2 | 3 | 3 | ... | 252 | 253 | 253 | 255 |

FIG. 6

1000

| gray level | 0 | ... | 100 | ... | 255 |
|---|---|---|---|---|---|
| adjusted value of R | 0 | ... | 1507 | ... | 4095 |
| adjusted value of G | 0 | ... | 1528 | ... | 4095 |
| adjusted value of B | 0 | ... | 1511 | ... | 4095 |

FIG. 7

IMAGE PROCESSING APPARATUS AND METHOD FOR ADJUSTING GRAY LEVELS OF AN IMAGE SIGNAL INPUTTED TO A FLAT DISPLAY PANEL

BACKGROUND OF THE INVENTION

1. Field of the Invention

The invention relates to an image processing apparatus and method, and more particularly, it relates to an image processing apparatus and method capable of improving the color quality of an image signal regarding brightness, color temperature, and color deviation simultaneously.

2. Description of the Prior Art

Flat display panel (FDP) is going to be the main trend for display systems in the future, wherein the most noticeable FDP is liquid crystal display (LCD). Because LCD has advantages of thinness, light weight, low radiation, low power consumption, high resolution, high brightness, etc., it can be applied to a broad application range, such as personal computer, business billboard, home theater, etc. That is to say, LCD is the most comprehensive FDP.

When a conventional LCD displays a white image frame, the displayed color always tends to appear blue. In chromatology, the aforesaid phenomenon means that the color temperature on the LCD is relatively high. When the ratio of brightness intensity of three fundamental colors outputted by the LCD is different with the correct brightness intensity, the displayed color will be affected. At the same time, the user may see color deviation on the image frame. For example, blue sky may seem a little green, and white clouds may seem a little yellow. Therefore, there are some methods disclosed in prior arts, such as U.S. Pat. No. 6,911,785, for solving the aforesaid problems of color temperature and color deviation.

However, when color temperature and color deviation are adjusted based on gray levels, brightness relative to the gray levels will also deviate. In other words, although color temperature and color deviation may get better after being adjusted based on gray levels, brightness relative to the gray levels may get worse.

Therefore, the main scope of the invention is to provide an image processing apparatus and method capable of improving color quality of an image signal regarding brightness, color temperature, and color deviation simultaneously.

SUMMARY OF THE INVENTION

A scope of the invention is to provide an image processing apparatus and method capable of improving color quality of an image signal regarding brightness, color temperature, and color deviation simultaneously, and capable of further reducing hardware resource.

According to a preferred embodiment, an image processing method of the invention is used to adjust gray levels of an image signal inputted to a flat display panel (FDP). The image processing method of the invention comprises steps of: (a) storing a panel characteristic look-up table (LUT), wherein the panel characteristic LUT is pre-established according to a brightness/gray level analysis process, a standard gamma analysis process, and a color temperature/color deviation analysis process; (b) receiving the image signal and adjusting gray levels of the image signal according to the panel characteristic LUT, so as to output an adjusted image signal complying with the panel characteristic of the FDP.

In addition, the invention also provides an image processing apparatus for adjusting gray levels of the image signal inputted to the FDP. The image processing apparatus comprises a memory unit and a processing unit. The memory unit stores the aforesaid panel characteristic LUT. The processing unit is used to receive the image signal and to adjust gray levels of the image signal according to the panel characteristic LUT, so as to output an adjusted image signal complying with the panel characteristics of the FDP.

According to the aforesaid description, the invention only needs to utilize the panel characteristic LUT to adjust the gray levels of the image signal to comply with the panel characteristic (e.g. brightness, color temperature, and color deviation) of the FDP. Because the panel characteristic LUT is pre-established according to the brightness/gray level analysis process, the standard gamma analysis process, and the color temperature/color deviation analysis process, it is unnecessary for the FDP to install a brightness (gamma) adjusting apparatus or a color temperature/color deviation adjusting apparatus. Accordingly, the hardware resource can be saved.

The advantage and spirit of the invention may be understood by the following recitations together with the appended drawing.

BRIEF DESCRIPTION OF THE APPENDED DRAWINGS

FIG. 4 is a schematic diagram illustrating a gain of the LUT (GainTable) being established by the color temperature/color deviation analysis process shown in FIG. 3.

FIG. 6 is a schematic diagram illustrating a gray level linear LUT (GrayTable) being established by the brightness/gray level analysis process shown in FIG. 5.

FIG. 7 is a schematic diagram illustrating the panel characteristic LUT of the panel shown in FIG. 1.

DETAILED DESCRIPTION OF THE INVENTION

Figure 1:
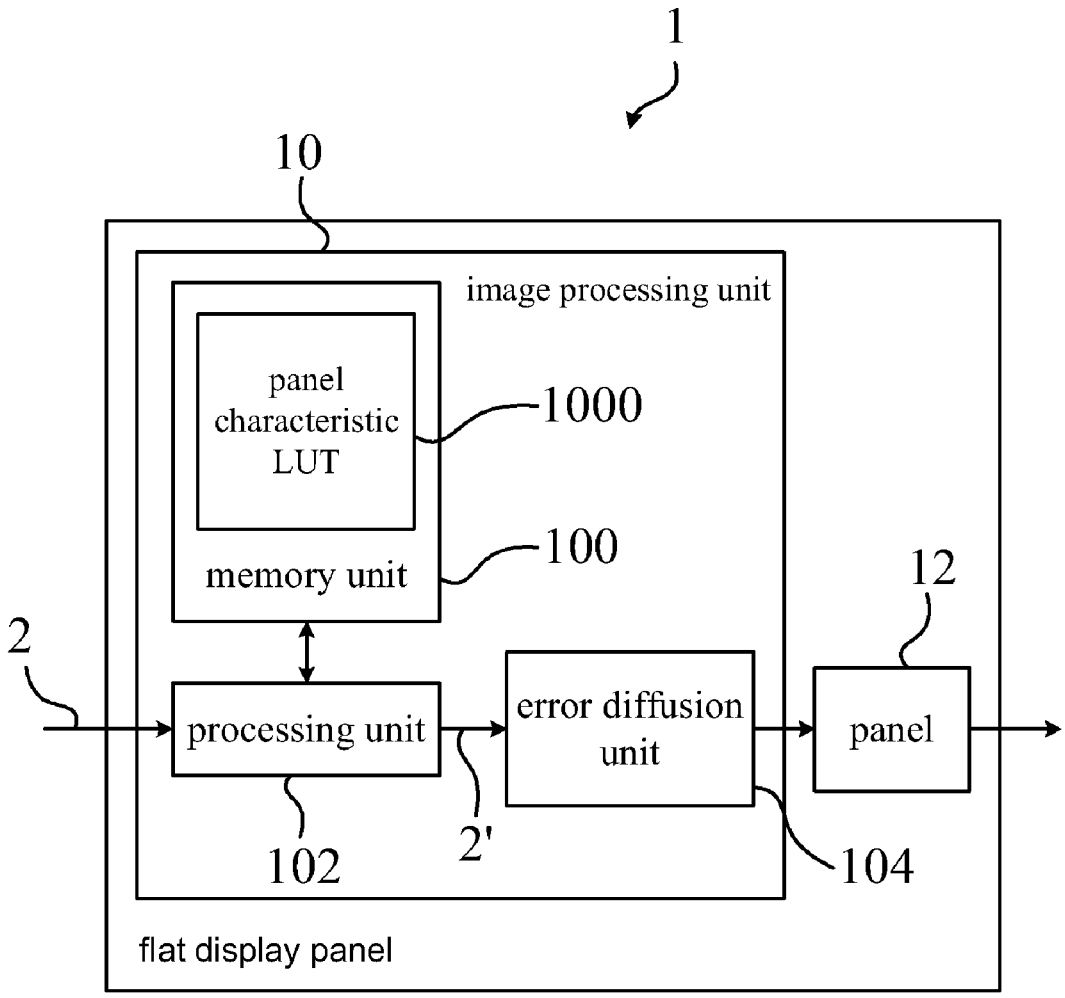
FIG. 1 is a functional block diagram illustrating a flat display panel (FDP) according to a preferred embodiment of the invention.

Referring to FIG. 1, FIG. 1 is a functional block diagram illustrating a flat display panel (FDP) 1 according to a preferred embodiment of the invention. The FDP 1 comprises an image processing apparatus 10 and a panel 12. The image processing apparatus 10 is used to adjust gray levels of an image signal 2 inputted into the FDP 1, such that the adjusted image signal 2' complies with the panel characteristic (e.g. brightness/gamma characteristic, color temperature, and color deviation) of the panel 12.

As shown in FIG. 1, the image processing apparatus 10 comprises a memory unit 100 and a processing unit 102. The memory unit 100 is used to store a panel characteristic LUT 1000, wherein the panel characteristic LUT 1000 is pre-establish according to a brightness/gray level analysis process, a standard gamma analysis process, and a color temperature/color deviation analysis process. The processing unit 102 is used to receive the image signal 2 and to adjust gray levels of the image signal 2 according to the panel characteristic LUT 1000 stored in the memory unit 100, so as to output the adjusted image signal 2' complying with the panel characteristic of the panel 12.

It should be noted that the panel characteristic LUT 1000 is pre-established and is then stored in the memory unit 100 for adjusting the image signal 2. In other words, the FDP 1 only needs to store the panel characteristic LUT 1000, such that the image signal 2 can be easily adjusted to comply with the panel characteristic of the panel 12.

The brightness/gray level analysis process, the standard gamma analysis process, and the color temperature/color deviation analysis process will be described in detail by the following examples.

Figure 2:
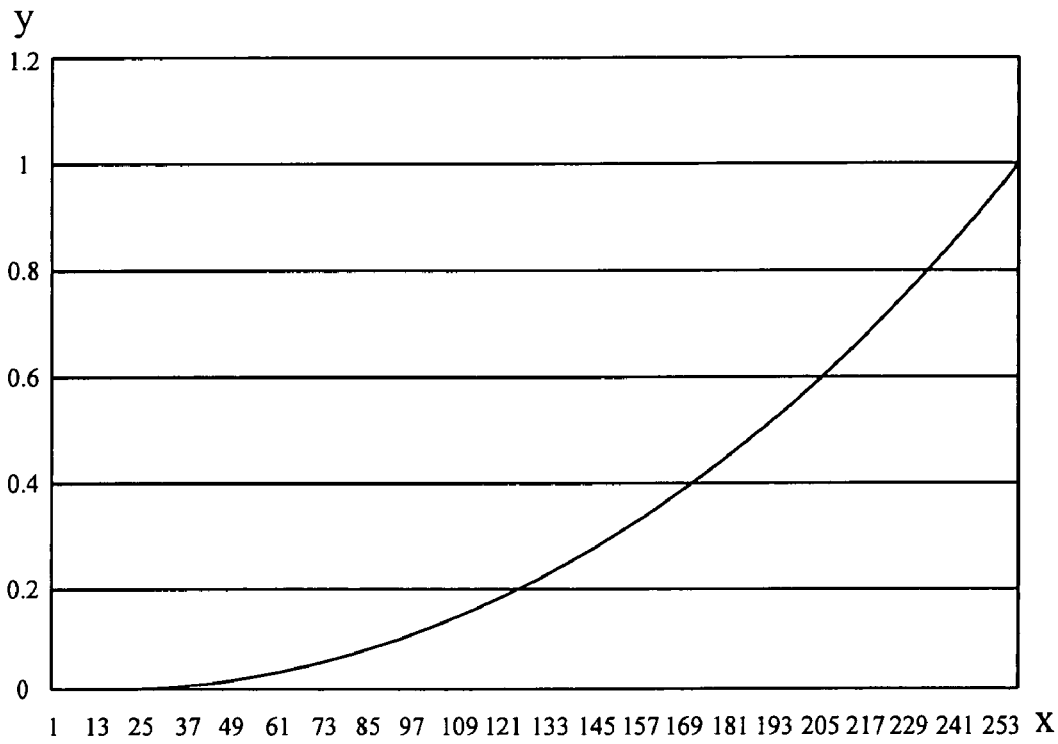
FIG. 2 is a schematic diagram illustrating a standard gamma 2.2 curve.

Standard Gamma Analysis Process:

Referring to FIG. 2, FIG. 2 is a schematic diagram illustrating a standard gamma 2.2 curve. The standard gamma analysis process is used to establish a standard gamma relation according to a standard gamma curve. The standard gamma relation is represented by the following formula 1.

Formula 1:

$$y = \left(\frac{x}{255}\right)^{\delta}.$$

In formula 1, x represents a gray level, y represents an output value corresponding to x, and δ represents a gamma characteristic. For example, if the gamma characteristic of the panel 12 is gamma 2.2, and the output value y is represented by 16 bits, the formula 1 can be further represented by the following formula 2.

Formula 2:

$$y_1 = 65535 * \left(\frac{x_1}{255}\right)^{2.2}.$$

Furthermore, if an image signal is converted by gamma 2.2, the image signal needs to be converted by gamma 0.45 (as formula 3 listed below) again, and then the image signal is linear.

Formula 3:

$$y_2 = 4095 * \left(\frac{x_2}{65535}\right)^{0.45}.$$

In formula 3, $x_2$ is represented by 16 bits, and $y_2$ is represented by 12 bits.

Figure 3:
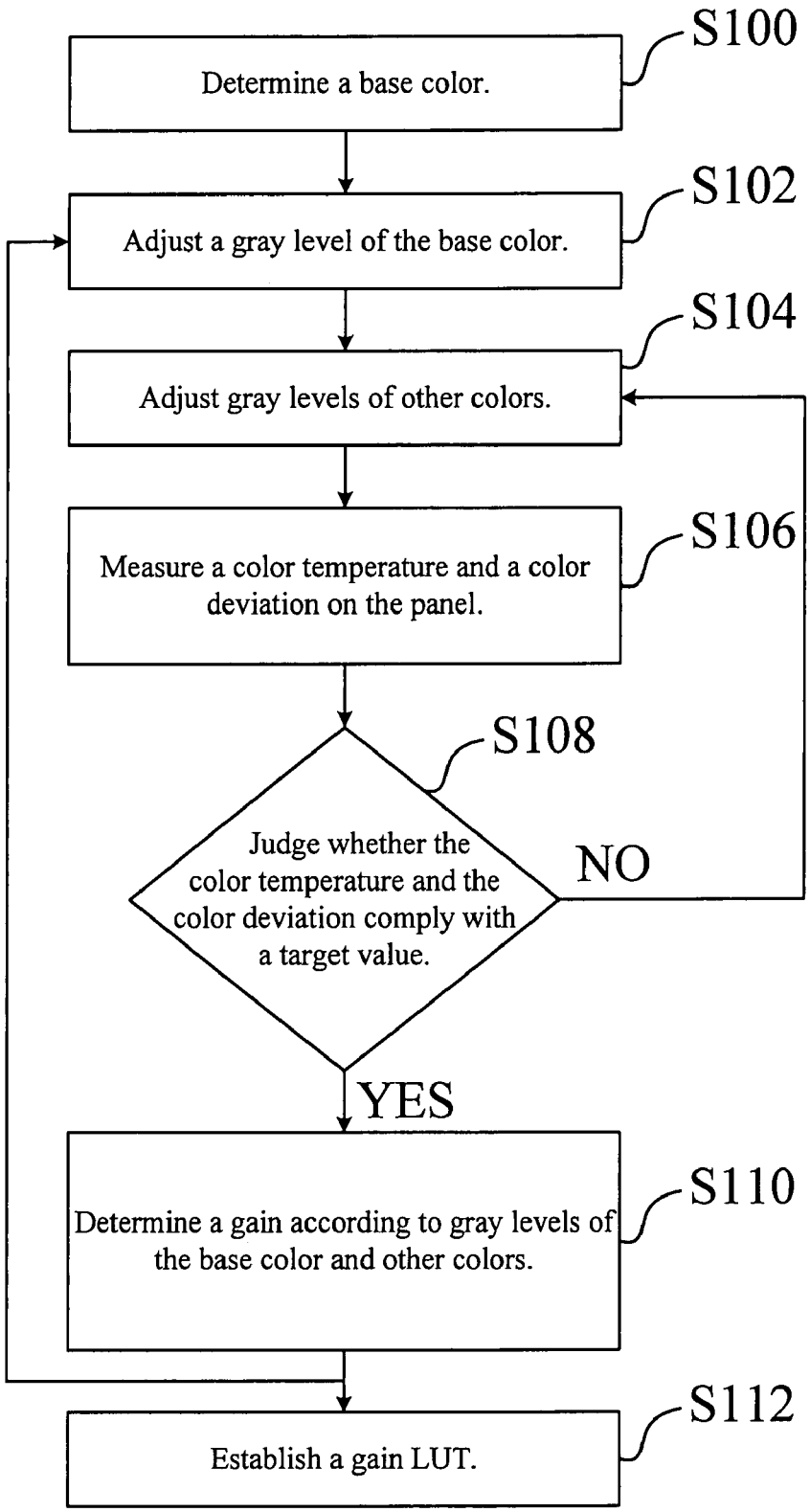
FIG. 3 is a flow chart showing the color temperature/color deviation analysis process.

Color Temperature/Color Deviation Analysis Process:

Referring to FIG. 3 and FIG. 4, FIG. 3 is a flow chart showing the color temperature/color deviation analysis process. FIG. 4 is a schematic diagram illustrating a gain of the LUT (GainTable) being established by the color temperature/color deviation analysis process shown in FIG. 3. In the beginning, step S100 is performed to determine a base color from three fundamental colors (RGB). Afterward, step S102 is performed to adjust a gray level of the base color. Step S104 is then performed to adjust gray levels of other colors. Step S106 is then performed to measure a color temperature and a color deviation on the panel 12 of the FDP 1. Step S108 is then performed to judge whether the color temperature and the color deviation comply with a target value. If it is a YES, step S110 is then performed; otherwise, the process will return to step S104. For example, a target color temperature can be but not limit to 9300 K, and a target color deviation can be but not limit to nearly zero. Step S10 is performed to determine a gain corresponding to each of the gray levels of other colors according to the gray levels of the base color and other colors. Finally, step S112 is performed to establish a gain LUT (GainTable) as shown in FIG. 4 by repeating steps S102 to S110.

As to the detail process of establishing the gain LUT (GainTable), please refer to U.S. Pat. No. 6,911,785, and the process will not be described in detail here again.

Figure 5:
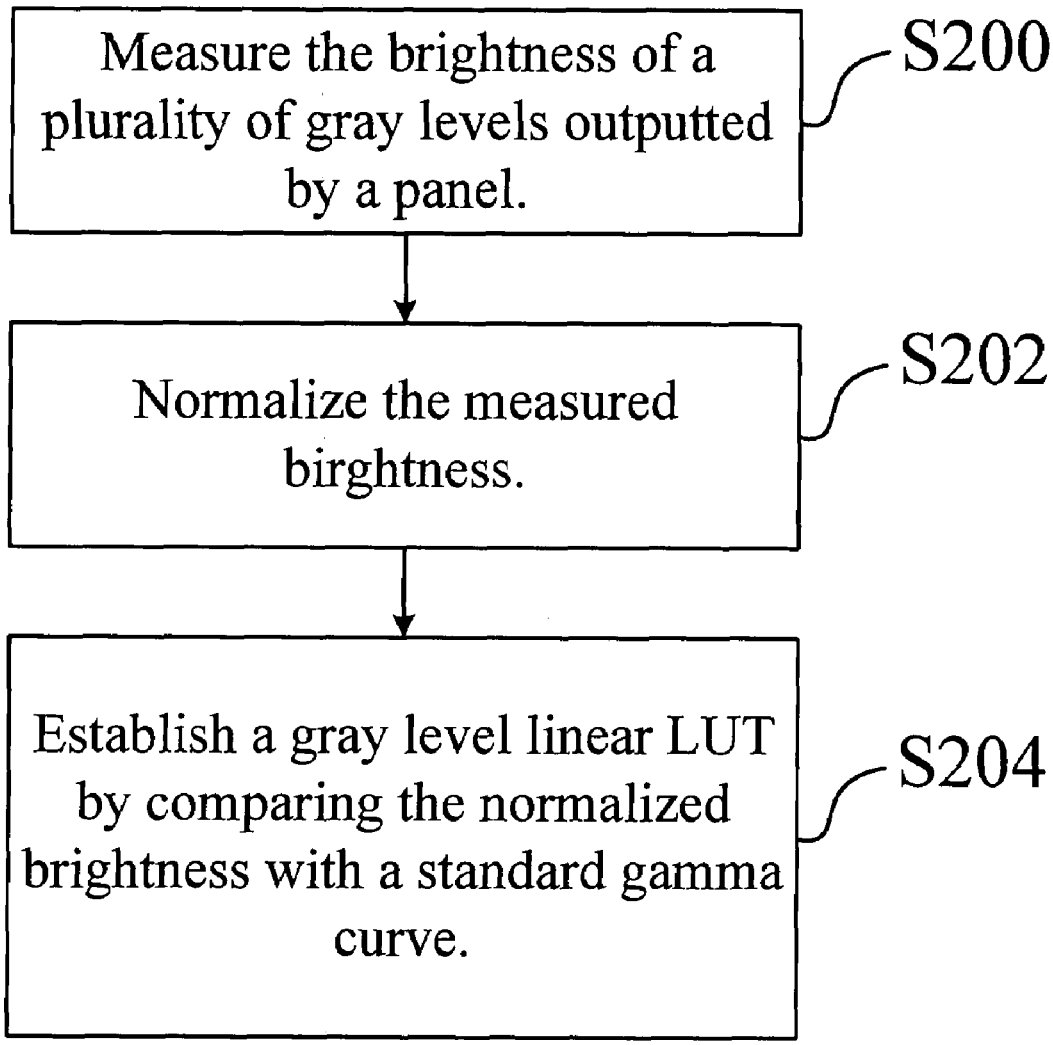
FIG. 5 is a flow chart showing the brightness/gray level analysis process.

Brightness/Gray Level Analysis Process:

Referring to FIG. 5 and FIG. 6, FIG. 5 is a flow chart showing the brightness/gray level analysis process. FIG. 6 is a schematic diagram illustrating a gray level linear LUT (GrayTable) being established by the brightness/gray level analysis process shown in FIG. 5. In the beginning, step S200 is performed to measure the brightness of a plurality of gray levels (e.g. 0~255 gray levels) outputted by the panel 12 of the FDP 1. Afterward, step S202 is performed to normalize the measured brightness. Finally, step S204 is performed to establish a gray level linear LUT (GrayTable) as shown in FIG. 6 by comparing the normalized brightness with a standard gamma curve (e.g. standard gamma 2.2 curve shown in FIG. 2).

Please refer to the gray level linear LUT (GrayTable) shown in FIG. 6. If an input gray level of R is 3, an output value of R should be 4 to comply with the gamma characteristic of the panel 12; if an input gray level of G is 4, an output value of G should be 5 to comply with the gamma characteristic of the panel 12, and so forth.

The panel characteristic LUT 1000 can be established by the following example.

Referring to FIG. 1 and FIG. 7, FIG. 7 is a schematic diagram illustrating the panel characteristic LUT 1000 shown in FIG. 1. For example, if an input gray level of R is 100, the adjusted gray level of R is 1507 (represented by 12 bits) according to the panel characteristic LUT 1000. The gray level can be adjusted by the following steps.

(1) According to the standard gamma analysis process, substitute $x_1$ with 100 in formula 2, then $y_1$=8358.

(2) According to the color temperature/color deviation analysis process, look up (8358/256)=33 in the gain LUT (GainTable shown in FIG. 4), then the gain of R is 0.85. Further, multiply 8358 by 0.85 to obtain 7104 (8358*0.85=7104).

(3) According to the brightness/gray level analysis process, look up the gray level linear LUT (GrayTable shown in FIG. 6), then 7104 is found to be between 6912 (27*256) and 7168 (28*256). Afterward, calculate the output value of R corresponding to 7104 by interpolation. Assume the output value of R corresponding to 7104 is 7111.

(4) According to the standard gamma analysis process, substitute $x_2$ with 7111 in formula 3, then $y_2$=1507. Accordingly, the gray level of R of the adjusted image signal 2' is 1507 (represented by 12 bits).

(5) Finally, record the input gray level (100) and the adjusted gray level (1507) in the panel characteristic LUT 1000.

According to the adjusting process above, an adjusted value (RGB) corresponding to each input gray level (0~255) can be calculated respectively, and then the panel characteristic LUT 1000 is completed.

Afterward, the panel characteristic LUT 1000 is stored in the image processing apparatus 10 of the FDP 1. Accordingly, when a gray level of R of one pixel of the image signal 2 is 100, the processing unit 102 of the image processing apparatus 10 will output the adjusted image signal 2' having the gray level of R as 1507, according to the panel characteristic LUT 1000.

Moreover, referring to FIG. 1 again, the image processing apparatus 10 may further comprise an error diffusion unit 104 for error-diffusing the adjusted image signal. Error diffusion can be achieved easily by one having ordinary skill in the art and will not be described in detail here again.

Compared to the prior art, the invention only needs to utilize the panel characteristic LUT to adjust the gray levels of the image signal to comply with the panel characteristic (e.g. brightness, color temperature, and color deviation) of the FDP. Because the panel characteristic LUT is pre-established according to the brightness/gray level analysis process, the standard gamma analysis process, and the color temperature/color deviation analysis process, it is unnecessary for the FDP to install a brightness (gamma) adjusting apparatus or a color temperature/color deviation adjusting apparatus. Accordingly, the hardware resource can be saved.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. An image processing method for adjusting gray levels of an image signal inputted to a flat display panel (FDP), comprising steps of:

storing a panel characteristic look-up table (LUT), the panel characteristic LUT being pre-established based on a brightness/gray level analysis process, a standard gamma analysis process, and a color temperature/color deviation analysis process; and receiving the image signal, and adjusting gray levels of the image signal according to the panel characteristic LUT, so as to output an adjusted image signal complying with a panel characteristic of the FDP;

wherein the panel characteristic LUT is established by the following steps:

(a) generating a first output gray level corresponding to an input gray level of the image signal according to the standard gamma analysis process;

(b) generating a second output gray level corresponding to the first output gray level in step (a) according to a gain LUT established by the color temperature/color deviation analysis process;

(c) generating a third output gray level corresponding to the second output gray level in step (b) according to a gray level linear LUT established by the brightness/gray level analysis process;

(d) generating a fourth output gray level corresponding to the third output gray level in step (c) according to the standard gamma analysis process; and (e) recording the fourth output gray level in step (d) and the corresponding input gray level in step (a) in the panel characteristic LUT.

2. The method of claim 1, wherein the panel characteristic of the FDP comprises a color temperature, a color deviation, and/or a gamma characteristic.

3. The method of claim 1, wherein the brightness/gray level analysis process comprises steps of:

measuring brightness of a plurality of gray levels outputted by the FDP;

normalizing the measured brightness; and establishing the gray level linear LUT by comparing the normalized brightness with a standard gamma curve.

4. The method of claim 1, wherein the standard gamma analysis process comprises the step of:

establishing a standard gamma relation according to a standard gamma curve.

5. The method of claim 1, wherein the color temperature/color deviation analysis process comprises steps of:

(a) determining a base color;

(b) adjusting a gray level of the base color;

(c) adjusting gray levels of other colors;

(d) measuring a color temperature and a color deviation on the FDP;

(e) judging whether the color temperature and the color deviation comply with a target value, if YES, performing step (f), if NO, returning to step (c);

(f) determining a gain corresponding to each of the gray levels of other colors according to the gray levels of the base color and other colors; and (g) establishing the gain LUT by repeating the steps (b) to (f).

6. The method of claim 1, further comprising the step of:

error-diffusing the adjusted image signal.

7. An image processing apparatus for adjusting gray levels of an image signal inputted to a flat display panel, comprising:

a memory unit for storing a panel characteristic LUT, the panel characteristic LUT being pre-established according to a brightness/gray level analysis process, a standard gamma analysis process, and a color temperature/color deviation analysis process; and a processing unit for receiving the image signal and for adjusting gray levels of the image signal according to the panel characteristic LUT, so as to output an adjusted image signal complying with a panel characteristic of the FDP;

wherein the panel characteristic LUT is established by the following steps:

(a) generating a first output gray level corresponding to an input gray level of the image signal according to the standard gamma analysis process;

(b) generating a second output gray level corresponding to the first output gray level in step (a) according to a gain LUT established by the color temperature/color deviation analysis process;

(c) generating a third output gray level corresponding to the second output gray level in step (b) according to a gray level linear LUT established by the brightness/gray level analysis process;

(d) generating a fourth output gray level corresponding to the third output gray level in step (c) according to the standard gamma analysis process; and (e) recording the fourth output gray level in step (d) and the corresponding input gray level in step (a) in the panel characteristic LUT.

8. The apparatus of claim 7, wherein the panel characteristic of the FDP comprises a color temperature, a color deviation, and/or a gamma characteristic.

9. The apparatus of claim 7, wherein the brightness/gray level analysis process is used to measure brightness of a plurality of gray levels of the FDP, to normalize the measured brightness, and to establish the gray level linear LUT by comparing the normalized brightness with a standard gamma curve.

10. The apparatus of claim 7, wherein the standard gamma analysis process is used to establish a standard gamma relation according to a standard gamma curve.

11. The apparatus of claim 7, wherein the color temperature/color deviation analysis process for creating the gain lookup table comprises the steps of:

(a) determining a base color;

(b) adjusting a gray level of the base color;

(c) adjusting gray levels of other colors;

(d) measuring a color temperature and a color deviation on the FDP;

(e) judging whether the color temperature and the color deviation comply with a target value, ifYES, performing step (f), if NO, returning to step (c);

(f) determining a gain corresponding to each of the gray levels of other colors according to the gray levels of the base color and other colors; and (g) establishing the gain LUT by repeating the steps (b) to (f).

12. The apparatus of claim 7, further comprising an error diffusion unit for error-diffusing the adjusted image signal.

* * * * *